United States Patent [19]

Mulawski

[11] 4,433,791

[45] Feb. 28, 1984

[54] PRESSURE RELIEF DEVICE FOR INTERNALLY PRESSURIZED FLUID CONTAINER

[75] Inventor: Walter J. Mulawski, Chelmsford, Mass.

[73] Assignee: Sexton Can Company, Inc., Everett, Mass.

[21] Appl. No.: 327,200

[22] Filed: Dec. 3, 1981

Related U.S. Application Data

[63] Continuation of Ser. No. 169,404, Jul. 16, 1980, abandoned.

[51] Int. Cl.[3] ..... B65D 51/16; B65D 83/14

[52] U.S. Cl. ..... 220/89 A; 137/68 R; 222/397

[58] Field of Search ..... 220/207, 89 A, 268, 220/70; 72/347, 346; 137/68 R, 68; 222/397

[56] References Cited

U.S. PATENT DOCUMENTS

| | | | |
|---|---|---|---|
| 2,795,350 | 6/1957 | Lapin | 220/89 A X |
| 3,292,826 | 12/1966 | Abplanalp | 220/89 A |
| 3,484,817 | 12/1969 | Wood | 220/89 A |
| 3,724,727 | 4/1973 | Zundel | 222/397 |
| 3,786,967 | 1/1974 | Giocomo et al. | 222/397 |
| 3,826,412 | 7/1974 | Knensel | 222/397 |
| 3,902,626 | 9/1975 | Jordan et al. | 220/268 |
| 3,979,009 | 9/1976 | Walker | 220/70 X |
| 3,998,174 | 12/1976 | Saunders | 220/70 X |
| 4,003,505 | 1/1977 | Hardt | 222/397 |
| 4,158,422 | 6/1979 | Witten et al. | 220/89 A |

OTHER PUBLICATIONS

Steel Plates and Their Fabrication, Lukens Steel Co.; Coatesville, Penna., 1947 pp. 111–115.

Defects and Failures of Metals, Polushkin; Elsevier Publishing Co., (Amsterdam, London, N. Y., Princeton); 1956 pp. 302, 303.

Strength and Resistance of Metals, Lessells; John Wiley and Sons, Inc., N. Y.; 1954 pp. 7 and 8.

Theory and Desing of Modern Pressure Vessels, 2nd Ed., Harvey I Von Nostrand Reinhold Co. (N. Y., Cinn., Toronto, London, Melborune); 1974, pp. 189–197.

*Primary Examiner*—Allan N. Shoap

*Attorney, Agent, or Firm*—Thompson, Birch et al.

[57] ABSTRACT

A pressure release device for an internally pressurized fluid container has a dome-shaped inwardly concave closure element circumferentially joined to one end of the tubular container side wall. The closure element is deep drawn of tempered steel, with a circular central area spaced from an annular outer area by an annular intermediate area traversed by radially extending Lüders Lines. A tab member is located in the central area. The tab member is partially circumscribed by a single weakened circular line of reduced material thickness, with the ends of the line being separated by a connecting area of substantially undisturbed material thickness and strength. The closure element has a structural integrity which reacts to an increase in fluid pressure in the container above a prescribed level by undergoing at least a partial eversion extending from the annular outer area, across the annular intermediate area into the circular central area to initiate a fracture of the closure element along the weakened line of reduced material thickness. The connecting area remains intact during any resulting outward deflection of the tab member occasioned by fluid escaping from the container through the fracture.

7 Claims, 12 Drawing Figures

PRESSURE RELIEF DEVICE FOR INTERNALLY PRESSURIZED FLUID CONTAINER

This is a continuation of application Ser. No. 169,404 filed Jul. 16, 1980 now abandoned.

BACKGROUND OF THE INVENTION

This invention relates to pressure release devices for internally pressurized fluid containers.

Pressurized fluid containers are in widespread use for packaging and dispensing a variety of fluid products, including liquids, gases and combinations thereof. Under normal operating conditions, such containers perform entirely satisfactorily. However, in the event that the contents of such containers should become over pressurized, either because of improper use, exposure to heat or for any other reason, then a violent rupture may occur. For the last 25 years, those skilled in the art have been attempting to solve this problem by incorporating various types of pressure release devices into the container structures. Examples of some of these previously developed pressure release devices are disclosed in U.S. Pat. Nos. 3,795,350 (Lapin); 3,074,602 (Shillady et al); 3,292,826 (Ablanalp); 3,622,051 (Benson); 3,826,412 (Kneusel); 3,831,822 (Zundel); and 4,003,505 (Hardt). However, for a variety of reasons including unreliability, high cost, difficulty of maintaining critical tolerances during manufacture, etc., none of these devices have proved to be acceptable.

The objective of the present invention is to provide an improved pressure release device which operates reliably within a predictable range of pressures, which is simple in design and capable of being mass produced, and which can be integrally incorporated into the container structure at a reasonable cost to the consumer.

SUMMARY OF THE INVENTION

The pressure release device of the present invention includes a dome-shaped inwardly concave closure element circumferentially joined to one end of a tubular container side wall. The closure element is deep drawn of tempered steel, with a circular central area spaced from an annular outer area by an annular intermediate area traversed by radially extending Lüders Lines. A tab member is provided in the central area. The tab member is partially circumscribed by single weakened line of reduced material thickness. The weakened line lies on a circle concentric with the focal point of the Lüders Lines and at the center of the closure element, with the ends of the weakened line being separated by a connecting area of substantially undisturbed material thickness and strength.

The closure element has a structual integrity which reacts to an increase in container pressure above a prescribed level by initially undergoing at least a partial eversion of the annular outer area. This eversion progresses rapidly in wave form in a generally radial direction across the annular intermediate area and into the circular central area to produce a stress concentration which causes a fracture of the closure element along the weakened line. As the over pressurized contents of the container are exhausted through this fracture, the tab member is deflected outwardly. The connecting area between the ends of the score line acts as a hinge which maintains a connected relationship between the outwardly deflected tab and the remainder of the closure element. The tab member is generally dome-shaped and outwardly convex.

BRIEF DESCRIPTION OF THE DRAWINGS

A preferred embodiment of the invention will now be described with reference to the accompanying drawings wherein.

DETAILED DESCRIPTION OF THE INVENTION

Figure 1:
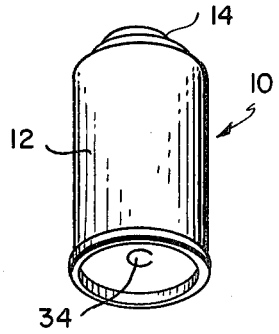
FIG. 1 is a bottom perspective view of a container including a closure element in accordance with the present invention.
Figure 4:
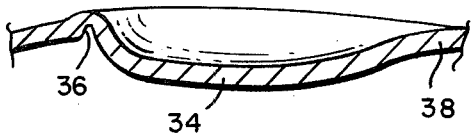
FIG. 4 is a sectional view on an enlarged scale taken along line 4—4 of FIG. 2.
Figure 2:
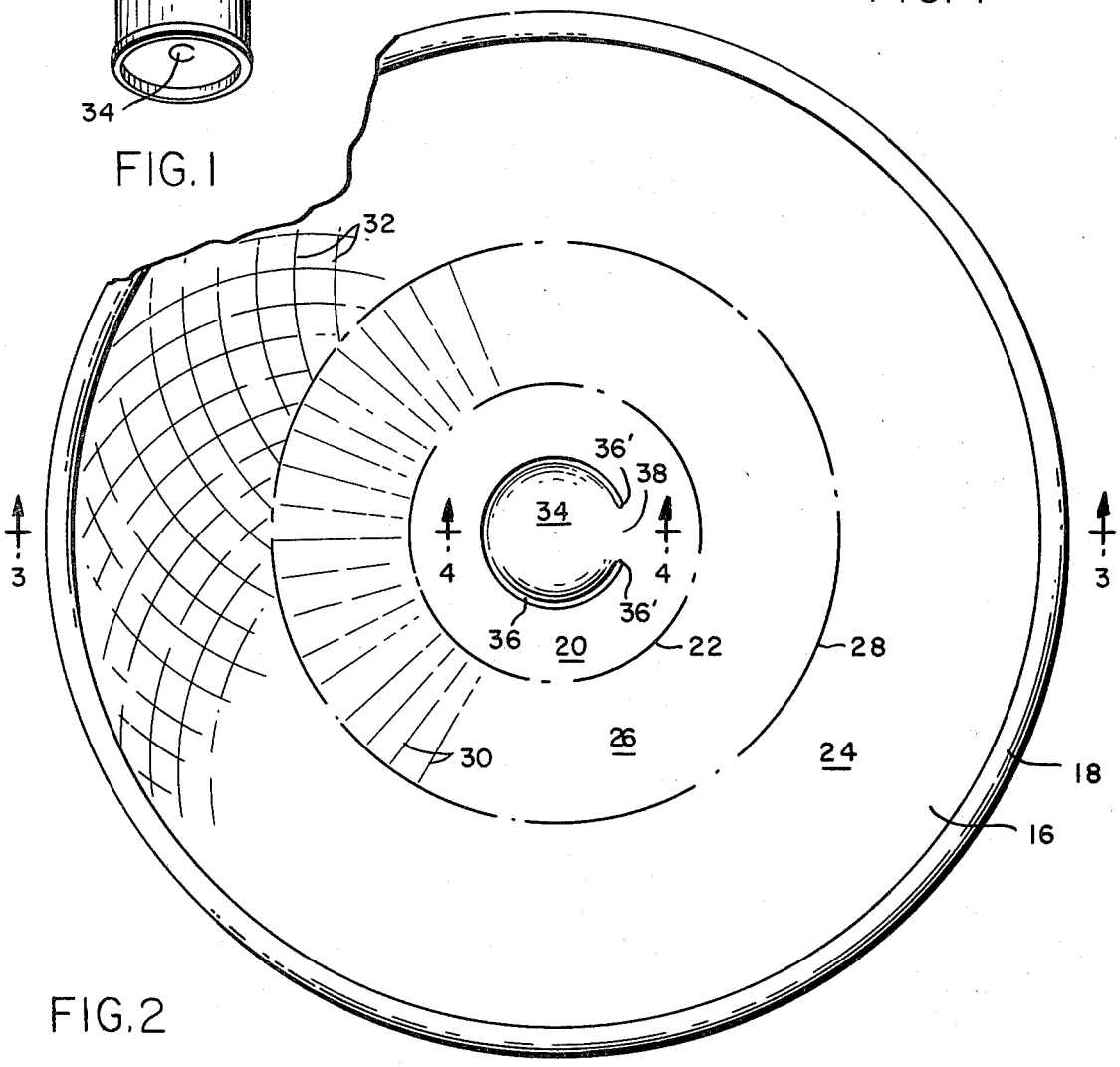
FIG. 2 is a bottom plan view on a greatly enlarged scale of the container shown in FIG. 1.
Figure 3:
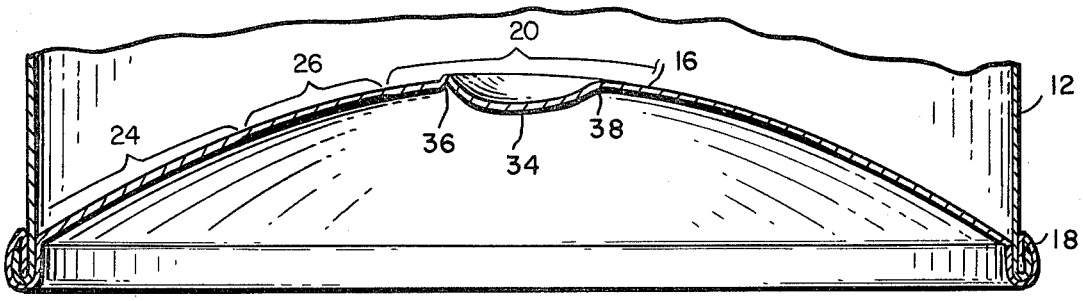
FIG. 3 is a sectional view taken along line 3—3 of FIG. 2.

Referring initially to FIGS. 1–4, a container of the type conventionally employed to package and dispense pressurized fluid is shown at 10. The container has a tubular metal side wall 12 which is stepped at one end as at 14 to accommodate a conventional cap or the like (not shown). A dome-shaped inwardly concave closure element 16 is applied to the opposite end of the side wall 12. The closure element may be circumferentially joined to the side wall by any conventional means, preferably the double seam connection indicated at 18 in the drawings.

The closure element 16 is deep drawn of tempered steel with a circular central area 20 illustratively defined in the drawings by an imaginary dot-dash line 22. The circular central area 20 is spaced from an annular outer area 24 by an annular intermediate area 26, again illustratively defined in the drawings by imaginary dot-dash lins 22 and 28.

The annular intermediate area 26 is traversed by radially extending Lüders Lines indicated typically at 30. The Lüers Lines are visible as surface markings, or surface roughening, caused by inhomogeneous yielding during the deep drawing operation. The closure element 16 is further characterized by a pattern of biaxial criss-crossed strain lines indicated typically at 32 in the annular outer area 24. These lines are also believed to be the result of inhomogeneous yielding during the deep drawing operation.

From the standpoint of material thickness, the annular intermediate area 26 is thinner than both the circular central area 20 and the annular outer area 24. The annular outer area 24 is thicker than the circular central area 20. These thickness relationships are again the result of the deep drawing operation.

A tab member 34 is located in the circular central area 20. The tab member is partially circumscribed by a single weakened line 36 of reduced material thickness. The line 36 lies on a circle concentric with the focal point of the Lüders Lines and the center of the closure element 16. The ends 36' of the weakened line 36 are separated by a connecting area 38 of substantially undisturbed material thickness and strength. The tab member 34 is dome-shaped and outwardly convex, with the weakened line 36 consisting of a groove in the concave outer surface.

Figure 5:
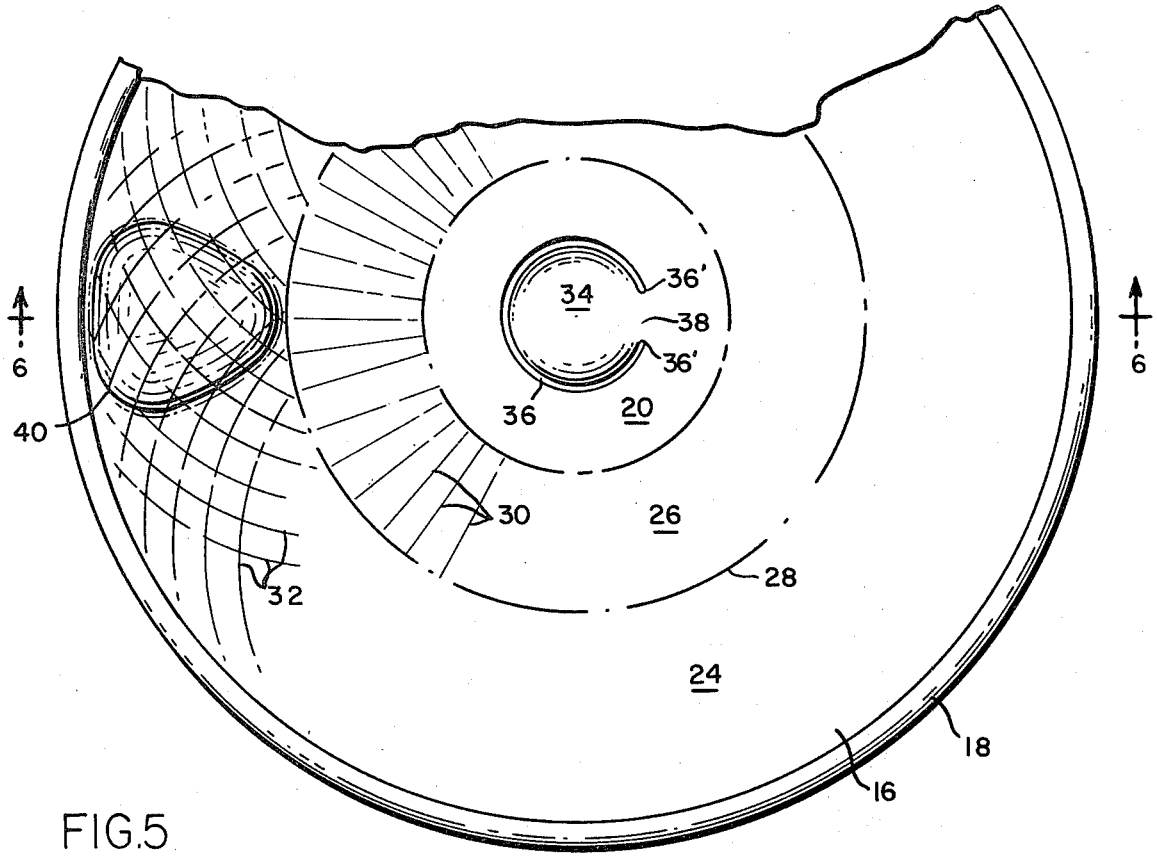
FIGS. 5 and 6 are views similar to FIGS. 2 and 3 showing the first stages of partial eversion as a result of the container contents being overpressurized.
Figure 6:
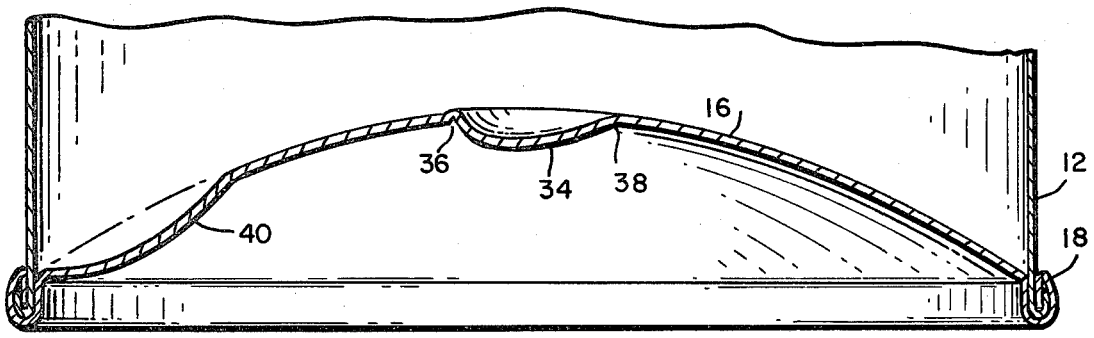
Figure 7:
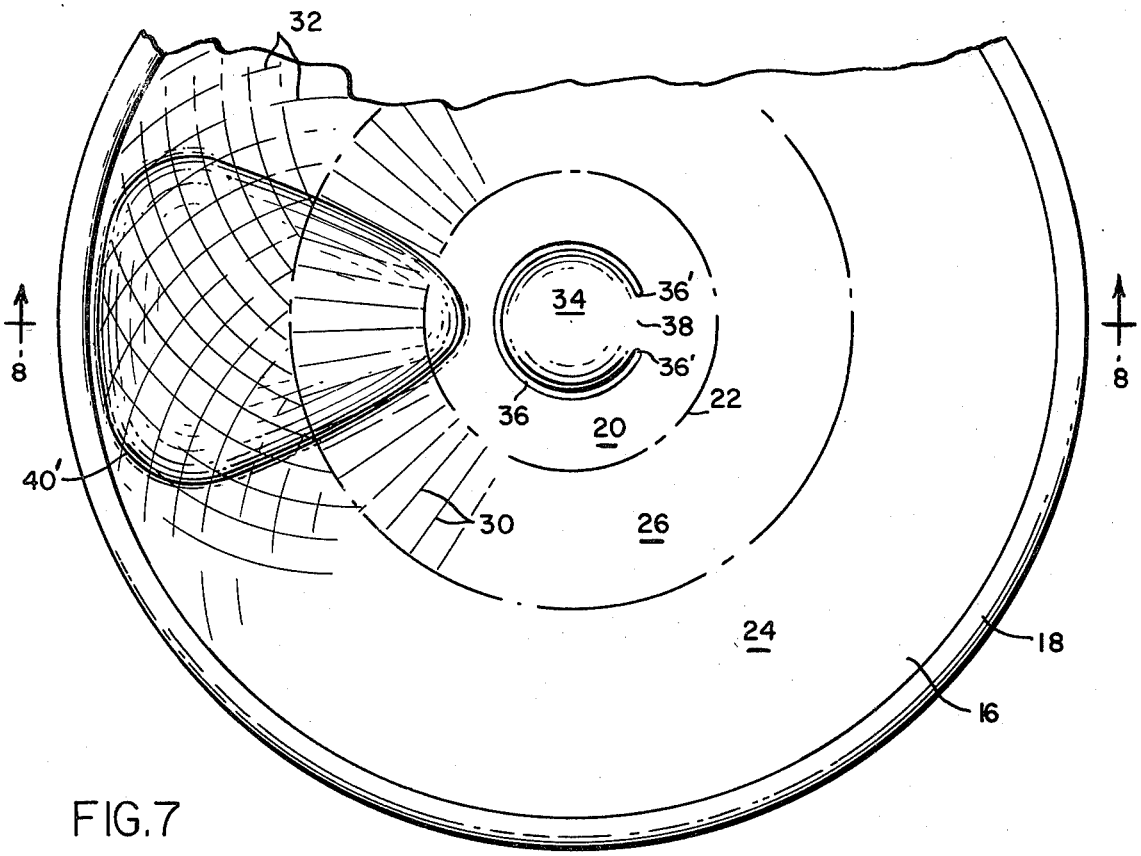
FIGS. 7 and 8 are again views similar to FIGS. 2 and 3 showing a further development of the partial eversion.
Figure 8:
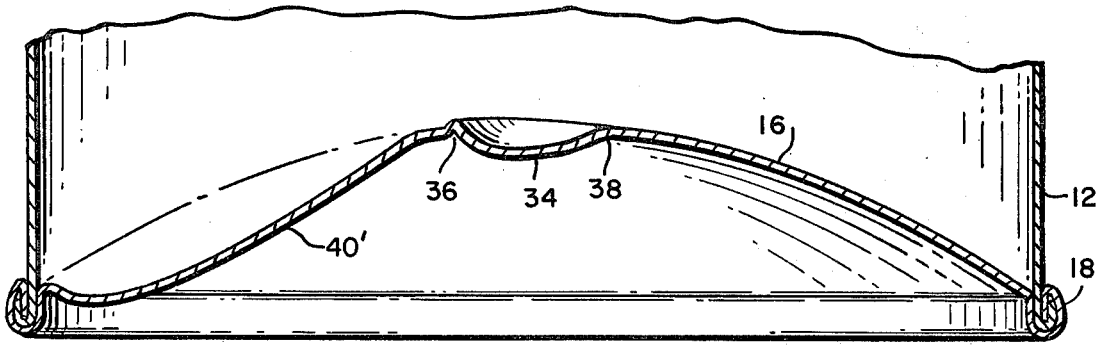
Figure 9:
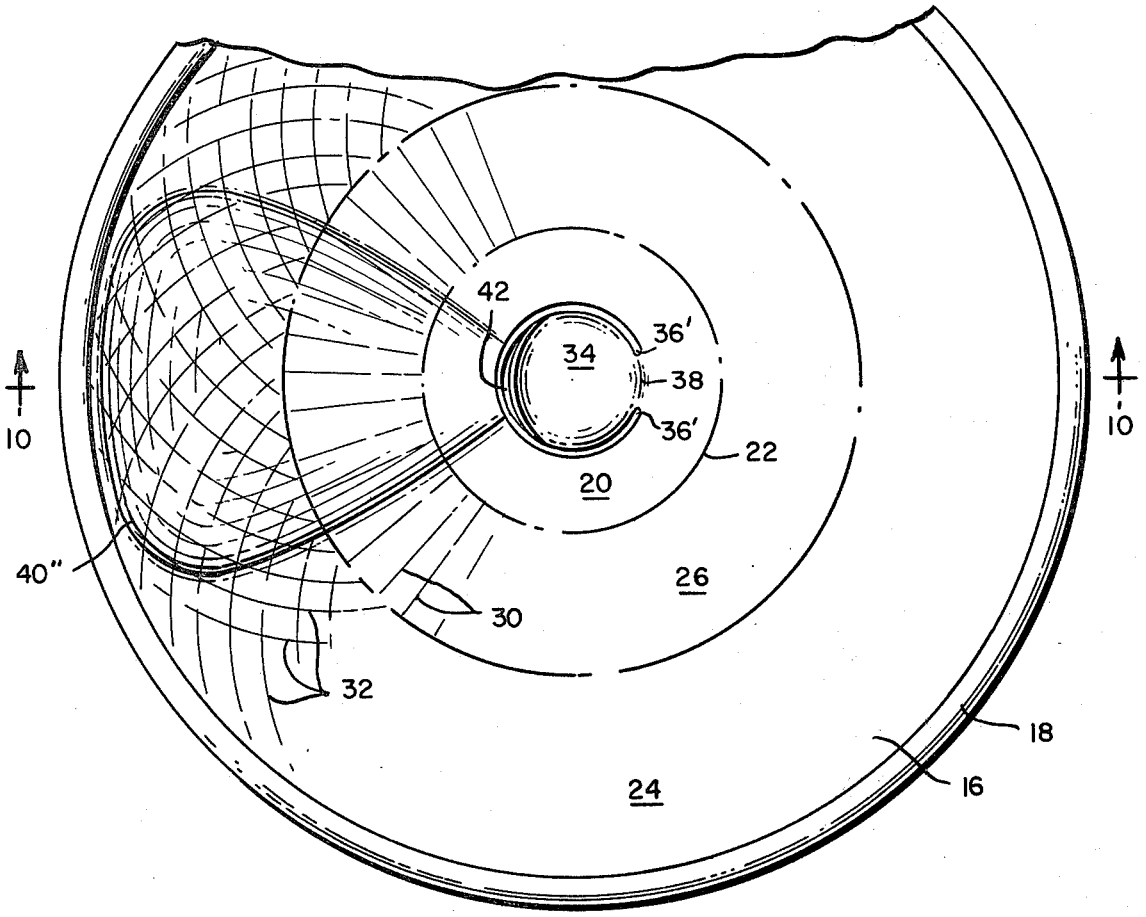
FIGS. 9 and 10 are again views similar to FIGS. 2 and 3 showing fracture of the weakened line surrounding the pressure release tab, with accompanying exhaustion of the overpressurized container contents.
Figure 10:
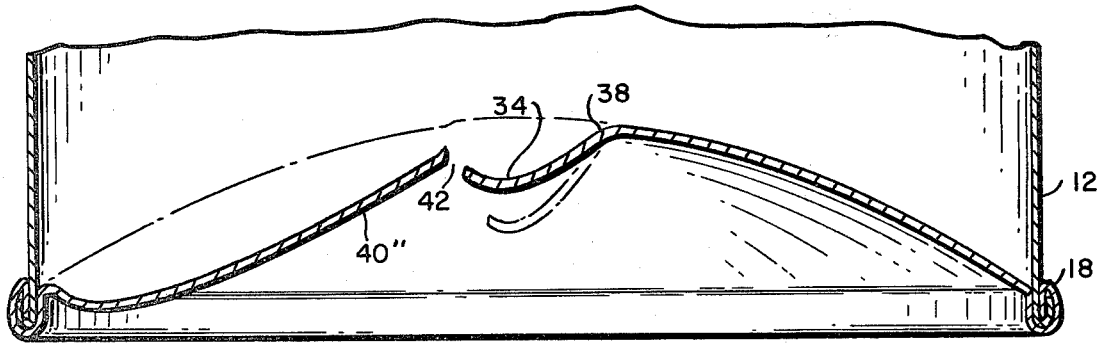

The closure element 16 has a structural integrity which reacts to an increase in fluid pressure above a prescribed level by initially undergoing at least a partial eversion at the annular outer area 24. An example of one such partial eversion is illustrated at 40 in FIGS. 5 and 6. Based on available experimental data, the initial eversion 40 appears to commence at random locations with respect to the outer rim of the closure element, with a rapid snap-through of a local area from the as-drawn inwardly concave configuration to the somewhat convex shape shown in the drawings. As illustrated in FIGS. 7 and 8, this area of initial eversion then progresses radially in a wave form as shown at 40' across the annular intermeidate area 26 into the circular central area 20. The radially arranged Lüders Lines appear to concentrate the inwardly radially spreading partial eversion 40"thereby setting up a high concentration of bending stresses along the weakened line 36 bordering the tab member 34. This high stress concentration is more than sufficient to initiate a local fracture of the closure element 16 along the weakened line 36 as indicated at 42 in FIGS. 9 and 10. The over pressurized contents of the can are then vented through the fracture 42. As this occurs, the fracture will progress around the line 36 allowing the venting rate to increase as necessary. The connecting area 38 serves as a hinge about which the tab member 34 is deflected outwardly under the influence of the escaping pressurized contents. Connecting area 38 has sufficient strength to withstand fracture, thereby maintaining the tab member 34 connected to the remainder of the closure element 16 as venting takes place.

Figure 11:
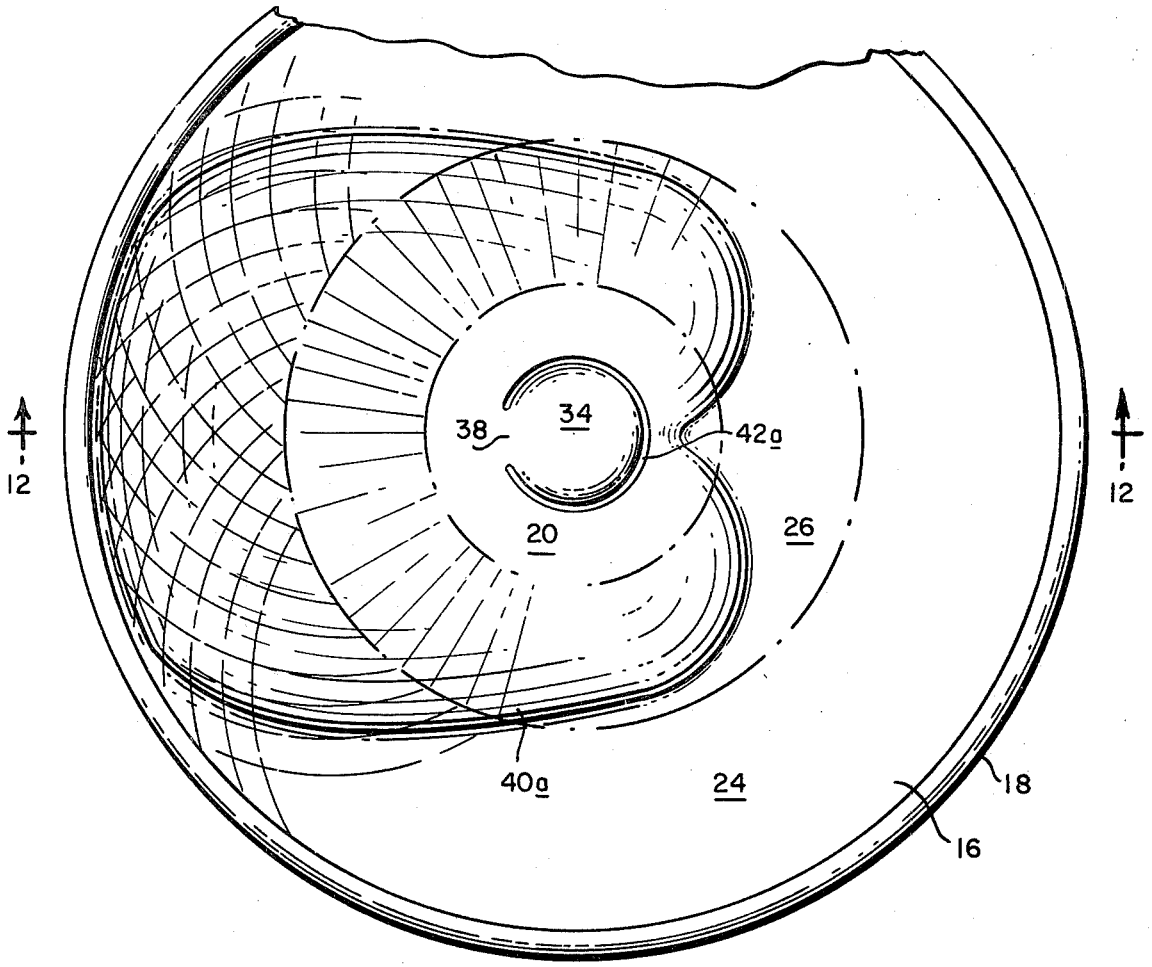
FIGS. 11 and 12 are views similar to FIGS. 9 and 10 showing the resulting fracture of the weakened line when the partial eversion occurs between the connecting area of the tab member and the container rim.
Figure 12:
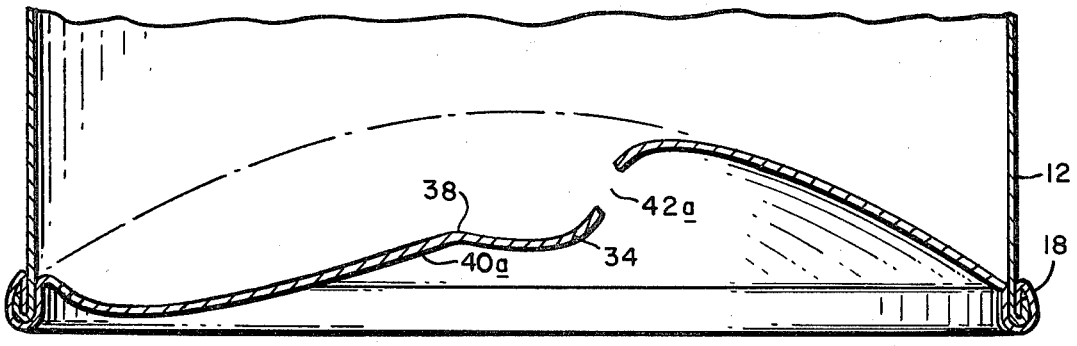

As previously indicated, initial localized eversion of the annular outer area occurs in a random manner. Under certain circumstances where this initial eversion occurs between the tab connecting area 38 and the outer rim of the closure element, the eversion will progress inwardly radially as indicated at **40*a* in FIGS. 11 and 12, eventually enveloping the tab member 34 before localized fracture occurs as at 42*a***.

A number of significant advantages result from the above-described combination of features. For example, by locating the tab member 34 centrally with respect to the Lüders Lines radially traversing the annular intermediate area 26, a fracture of the weakened line 36 can be achieved dependably within a predictable pressure range due to the concentration of bending stresses accompanying pressure-actuated eversion. This concentration of bending stresses is sufficiently great to compensate for variations in material strength and thickness at the weakened line 36 as a result of normal tool wear.

The central circular area 20 is relatively unstressed with a lower order of work hardening as compared to annular areas 26 and 24. Thus, the connecting area 38 has the strength and flexibility to maintain a connected relationship between the tab member 34 and the remainder of the closure element 16 following fracture at the weakened line 36.

The outwardly convex configuration of the tab member 34 relative to the inwardly concave shape of the remainder of the closure element 16 also is advantageous in that it insures that the material on opposite sides of the weakened line 36 is pulled apart under tension rather than being pressed together at the moment of fracture.

Because of its configuration and location, the tab member 34 is particularly suited to mass production techniques, without unduly increasing costs to the consumer.

I claim:

1. A pressure release device for an internally pressurized fluid container of the type having a tubular side wall, said device comprising:

a dome-shaped inwardly concave closure element circumferentially joined to one end of said side wall, said closure element being deep drawn of tempered steel, with a circular central area spaced from an annular outer area by an annular intermediate area traversed by radially extending Lüders Lines, a dome-shaped outwardly convex tab member in said central area, said tab member being partially circumscribed by a single weakened line of reduced material thickness, said line lying on a circle, with the ends of said line being separated by a connecting area of substantially undisturbed material thickness and strength, said closure element having a structural integrity which reacts to an increase in fluid pressure in said container above a prescribed level by undergoing at least a partial eversion which initially occurs at said annular outer area and thereafter progresses across said annular intermediate area into said circular central area to initiate a fracture of the closure element along said weakened line of reduced material thickness by pulling the opposite sides of said line apart, with the said connecting area remaining intact during any resulting outward deflection of the tab member occasioned by fluid escaping from said container through said fracture.

2. The pressure release device of claim 1 wherein said circle is concentric with the focal point of said Lüders Lines.

3. The pressure release device of claims 1 or 2 wherein said circle is concentric with the center of said closure element.

4. The pressure release device of claim 3 wherein said annular outer area is thicker than said central circular area.

5. The pressure release device of claim 1 wherein said annular intermediate area is thinner than said central circular area and said annular outer area.

6. The pressure release device of claim 1 wherein the stresses resulting from said eversion are directed by said Lüders Lines towards said weakened line of reduced material thickness.

7. A pressure release device for an internally pressurized fluid container of the type having a tubular side wall, said device comprising:

a dome-shaped inwardly concave closure element circumferentially joined to one end of said side wall, said closure element being deep drawn of tempered steel, with a circular central area spaced from an annular outer area by an annular intermediate area traversed byradially extending Lüders Lines, a tab member in said central area, said tab member being partially circumscribed by a single weakened line of reduced material thickness, said line lying on a circle concentric with the focal point of said Lüders Lines and with the center of said closure element, with the ends of said line being separated by a connecting area of substantially undisturbed material thickness and strength, said tab member being generally dome-shaped and outwardly convex, said closure element having a structural integrity which reacts to an increase in fluid pressure in said container above a prescribed level by undergoing at least a partial eversion which initially occurs at said annular outer area and thereafter progresses across said annular intermediate area into said circular central area to initiate a fracture of the closure element along said weakened line of reduced material thickness by pulling the opposite sides of said line apart, with the said connecting area remaining intact during any resulting outward deflection of the tab member occasioned by fluid escaping from said container through said fracture.

* * * * *